United States Patent [19]

Otsuka et al.

[11] 4,455,932

[45] Jun. 26, 1984

[54] HYDRAULIC CYLINDER APPARATUS

[75] Inventors: Tsuruo Otsuka, South Holland; Anthony A. Cristofano, Oak Lawn, both of Ill.

[73] Assignee: Verson Allsteel Press Company, Chicago, Ill.

[21] Appl. No.: 478,719

[22] Filed: Mar. 25, 1983

[51] Int. Cl.[3] ..... B30B 15/04

[52] U.S. Cl. ..... 100/214; 100/269 R

[58] Field of Search ..... 100/214, 269 R; 72/453.14, 456; 92/165 R, 165 PR, 166, 167; 83/639

[56] References Cited

U.S. PATENT DOCUMENTS

| | | | |
|---|---|---|---|
| 3,321,952 | 5/1967 | Wagner | 100/214 X |
| 3,592,131 | 7/1971 | Otsuka | 100/269 R |

FOREIGN PATENT DOCUMENTS

| | | | |
|---|---|---|---|
| 2319920 | 11/1974 | Fed. Rep. of Germany | 100/214 |
| 424739 | 10/1974 | U.S.S.R. | 100/269 R |

*Primary Examiner*—Billy J. Wilhite

*Attorney, Agent, or Firm*—Wallenstein, Wagner, Hattis, Strampel & Aubel

[57] ABSTRACT

An improved hydraulic press having adjustable preloading or prestressing means on the cylinder body to compensate for, and neutralize, any deflection or deformation of the cylinder body under the hydraulic pressures at which the press operates. The press is designed to operate at zero clearance.

8 Claims, 5 Drawing Figures

HYDRAULIC CYLINDER APPARATUS

The present invention relates to an improved hydraulic press, and, in particular, to an improved hydraulic press wherein the piston body of the press is adapted to operate at zero clearance.

The hydraulic press of this invention represents an improvement over the hydraulic press which is the subject matter of U.S. Pat. No. 3,592,131. In the operation of a hydraulic press of the type shown in the patent, the cylinder of large diameter at the open end of the hollow cylinder body is deformed or deflected slightly under load. More specifically in this connection, fluid pressure within the cylinder of the press causes radial expansion of the cylinder. In order to develop fluid pressure, load must be applied to the movable platen of the press which must be resisted by the stationary platen of the press. Under load, the diagonal distance across the tie rods of the press decreases, while the distance across the cylinder, at midpoints between the tie rods, increases. This deflection, while small, can result in severe overloading of the rollers which guide the ram extension of the piston body during its upstroke, and which are mounted within the large diameter of the cylinder as is the case with the press shown in the aforementioned patent. Overloading of the rollers can adversely affect their useful life.

As disclosed in U.S. Pat. No. 3,592,131, zero clearance for the guiding of the ram extension of the piston body is attained by radially adjusting a plurality of circumferentially spaced rollers carried on roller supports secured directly to the cylinder body. The roller supports are vertically adjustable with relation to brackets which extend downwardly along the periphery of the large diameter cylinder at the upper, open end of the hollow cylinder body of the press, and the amount of vertical adjustment of the roller supports is determined by a shim associated with each of the brackets and the roller supports. By appropriate grinding, the thickness of the shims may be adjusted to cause the rollers to engage the ram extension of the piston body with a desired amount of preloading. When all of the rollers are thusly radially adjusted, zero clearance for the guiding of the ram extension of the piston body is provided. While the arrangement disclosed in the patent is capable of providing preloading to obtain zero clearance for the stated purpose, in accordance with the present invention, improved preloading or prestressing means has been evolved which more simply, effectively and efficiently enables a desired amount of preloading to be applied at critical areas of a hydraulic press. The preloading or prestressing means of this invention acts to neutralize and dissipate any deflection or bending of the components of a hydraulic press under load thereby preventing any overloading of the rollers which guide the ram extension of the piston body of the press. The resulting longer useful life of the rollers has important economic advantages both from the standpoint of parts replacement costs and press downtime.

In brief, the preloading or prestressing means comprises radially adjustable, piston engaging guide means, and vertically adjustable, cylinder body engaging means. The piston engaging guide means and the cylinder body engaging means advantageously are supported on a plate member adapted to be removably secured to the cylinder body of a hydraulic press. The plate member is provided with a central opening, and the piston engaging guide means which, in a preferred embodiment of the invention, comprises a plurality of rollers, of the type disclosed in U.S. Pat. No. 3,592,121, arranged in circumferentially spaced relation to one another at the opening in the plate member. The plate member also is provided with a plurality of extensions adapted to be positioned between the tubular columns surrounding the tie rods of a hydraulic press. The extensions support the vertically adjustable, cylinder body engaging means. In a preferred embodiment of the invention, the cylinder body engaging means comprises a retainer plate and a wedge-like member having interengaging cam surfaces. The retainer plate and the wedge-like member desirably are adjustably secured on an outer, overhanging margin or edge portion of the extensions of the plate member in a manner to enable a surface of the wedge-like member to engage the outer surface of the cylinder body. By proper adjustment of the rollers in relation to the piston body, and the wedge-like members along the margins of the extensions of the plate member, any bending and shear deflection to which the cylinder body of a hydraulic press is subjected under load will be effectively neutralized resulting in zero clearance for the guiding of the piston body. This arrangement prevents overloading of the guide rollers of the press, and provides much greater accuracy, and substantially reduces any deflection of the movable platen of the press when it is subjected to off center loading.

The foregoing, and other features and advantages of the present invention will become apparent to those skilled in the art upon reference to the accompanying specification, and drawings wherein.

Figure 1:
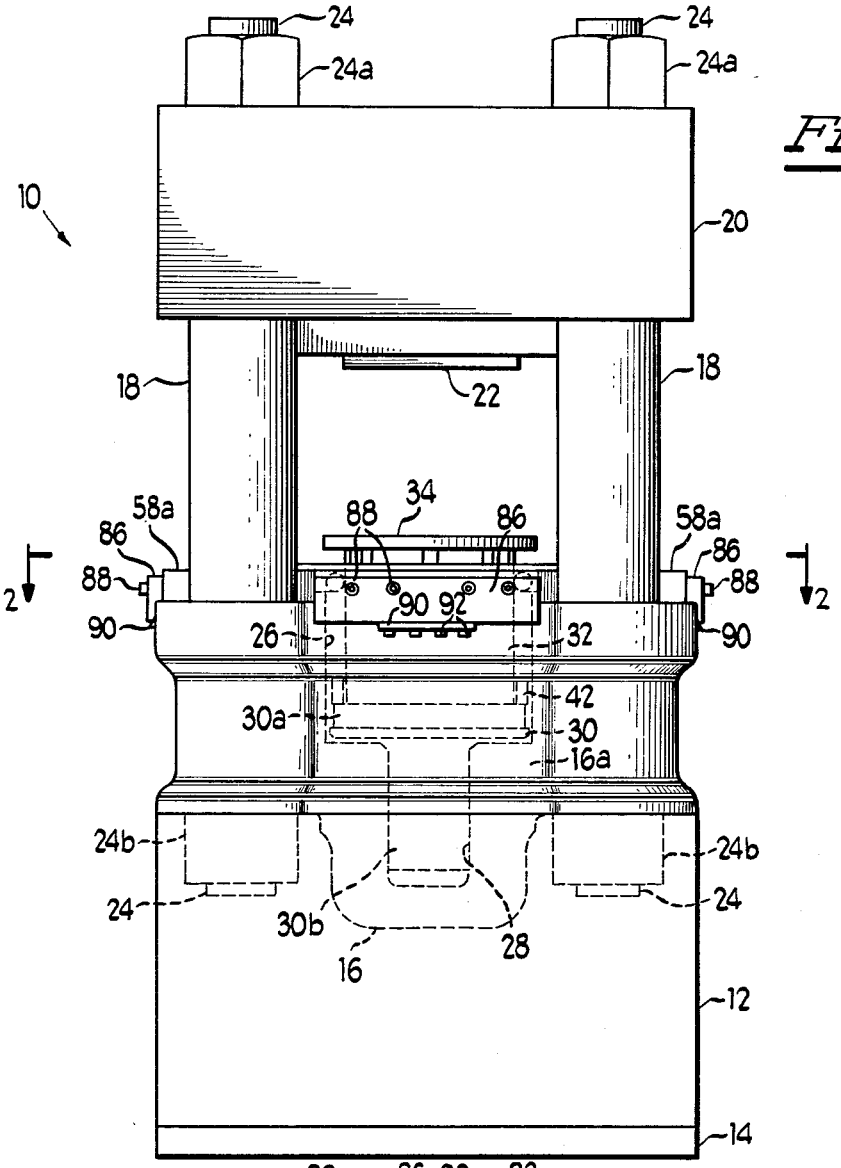
FIG. 1 is a front elevational view of a press structure incorporating an embodiment of the present invention.
Figure 2:
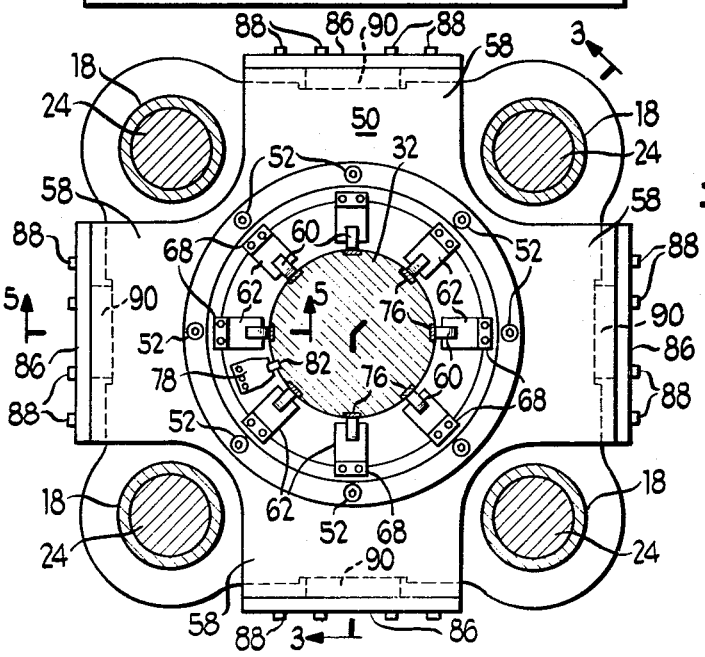
FIG. 2 is a horizontal sectional view taken substantially along line 2—2 of FIG. 1.
Figure 3:
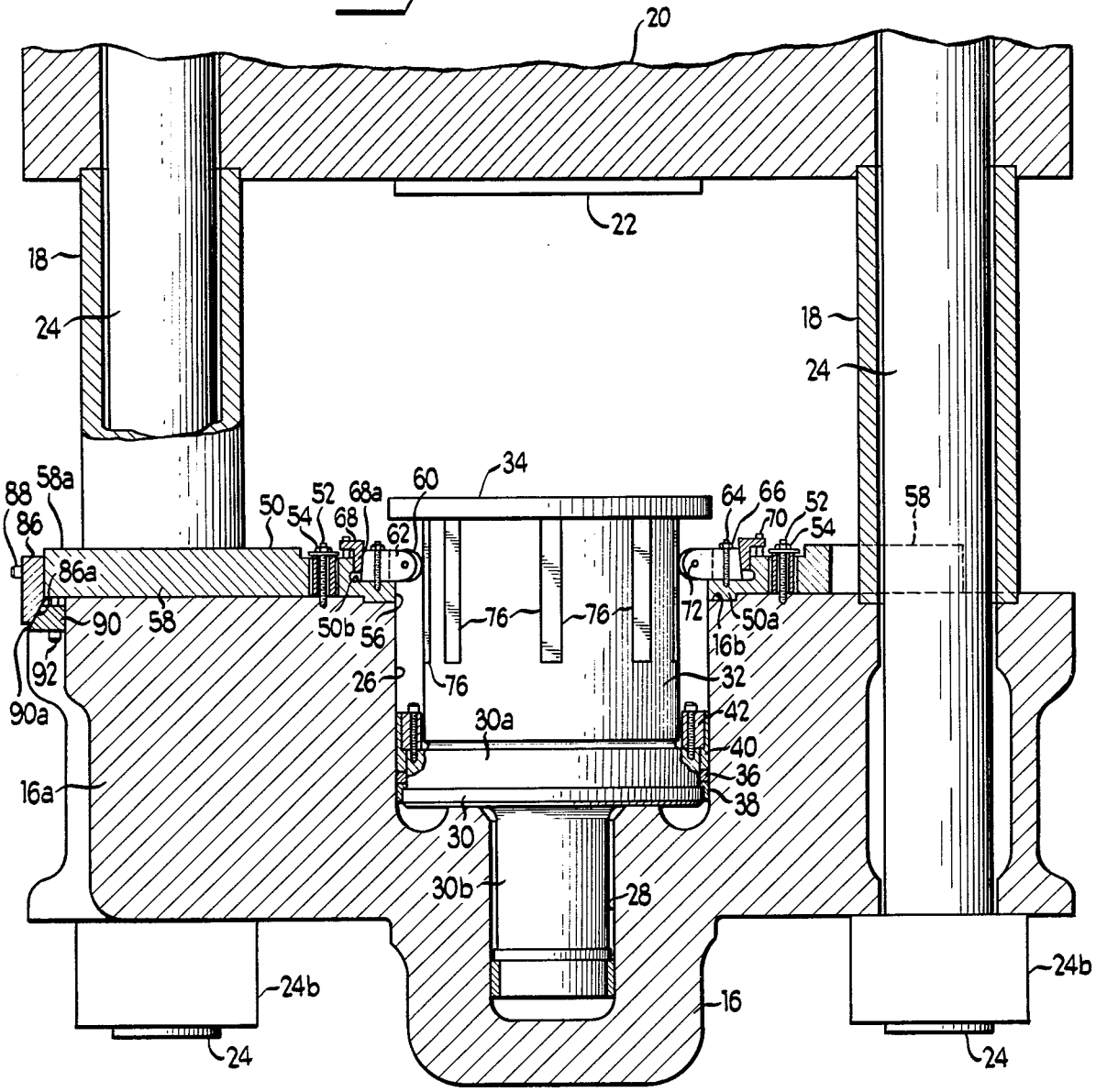
FIG. 3 is an enlarged vertical sectional view taken substantially along line 3—3 of FIG. 2.

Since the present invention represents an improvement in the hydraulic cylinder apparatus disclosed in U.S. Pat. No. 3,592,131, the invention will be described in relation to its use in such apparatus. However, it should be understood that the invention may be used in other forms of the apparatus, including a hydraulic press employing three instead of four tie rods, for example, as shown in said patent. Referring, now, in particular, to FIGS. 1, 2 and 3 of the drawings, the press structure diagrammatically illustrated, and designated generally by reference numeral 10, includes a supporting base 12 suitably secured to a foundation 14. A bed member 16 is secured to the base 12, and a plurality of tubular columns 18 extend upwardly from the bed member 16 to support a crown member 20. As shown, the crown member 20 is provided with a downwardly facing stationary platen 22. The press structure 10 advantageously is prestressed by means of threaded tie rods 24 which extend through the bed member 16, the column 18 and the crown member 20 upon which tie rod nuts **24*a* and 24*b*** are threadly mounted for prestressing purposes.

The bed member 16 is in the form of a hydraulic cylinder body 16a which is open at the top and closed at the bottom. The cylinder body 16a has a cylinder 26 of large diameter at the open end thereof, and a cylinder 28 of small diameter at the closed end communicating with the cylinder 26 substantially midway between the open and closed end of the cylinder body 16a. A piston body 30 is longitudinally movably received in the cylinder body 16a, and intermediate its ends is provided with a piston 30a of large diameter which is received in the large diameter cylinder 26. The piston body 30 also includes a piston extension 30b of small diameter which is received in the small diameter cylinder 28, and a ram extension 32 of intermediate diameter which extends through the open end of the cylinder 26. A platen 34 is secured to the top of the ram extension 32, and constitutes the movable platen of the hydraulic press structure 10. The piston 30a is provided with annular hydraulic packing 36 which is held in place by a shouldered bushing 38 engaging a shoulder on the piston 30a and a shouldered bushing 40 having an upwardly facing shoulder. A retainer ring 42 is suitably secured to the piston 30a, and engages the shoulder on the bushing 40 for maintaining the bushings 38 and 40 and the hydraulic packing 36 in place on the piston 30a.

Figure 5:
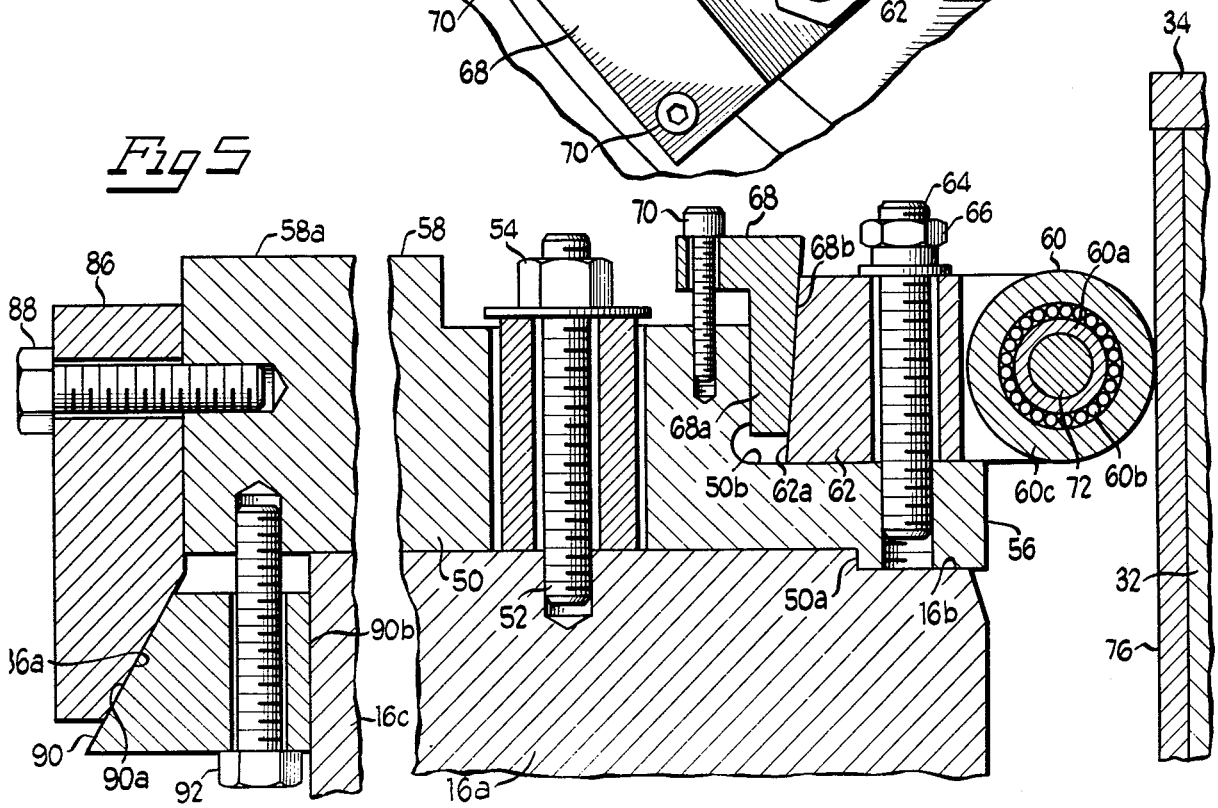
FIG. 5 is a fragmentary vertical sectional view taken substantially along line 5—5 of FIG. 2.

As best illustrated in FIGS. 2, 3 and 5 of the drawings, the preloading or prestressing means of the present invention comprises a plate member 50 secured to the cylinder body 16a by screws 52 and nuts 54. The plate member 50 is provided with a central opening 56 through which the upper portion of the ram extension 32 and the platen 34 extend. Radiating outwardly from the opening 56 are a plurality of spaced extensions 58 which, as shown in FIG. 2, are positioned substantially midway between the tubular columns 18, and their associated tie rods 24, of the press 10. While the plate member 50 is illustrated as having two pairs of opposed extensions, the number of extensions on the member 50 will be determined by the number of tie rods comprising the press. Thus, in a three tie rod press, the plate member will have a corresponding number of extensions, each extension being positioned substantially midway between the tie rods.

Figure 4:
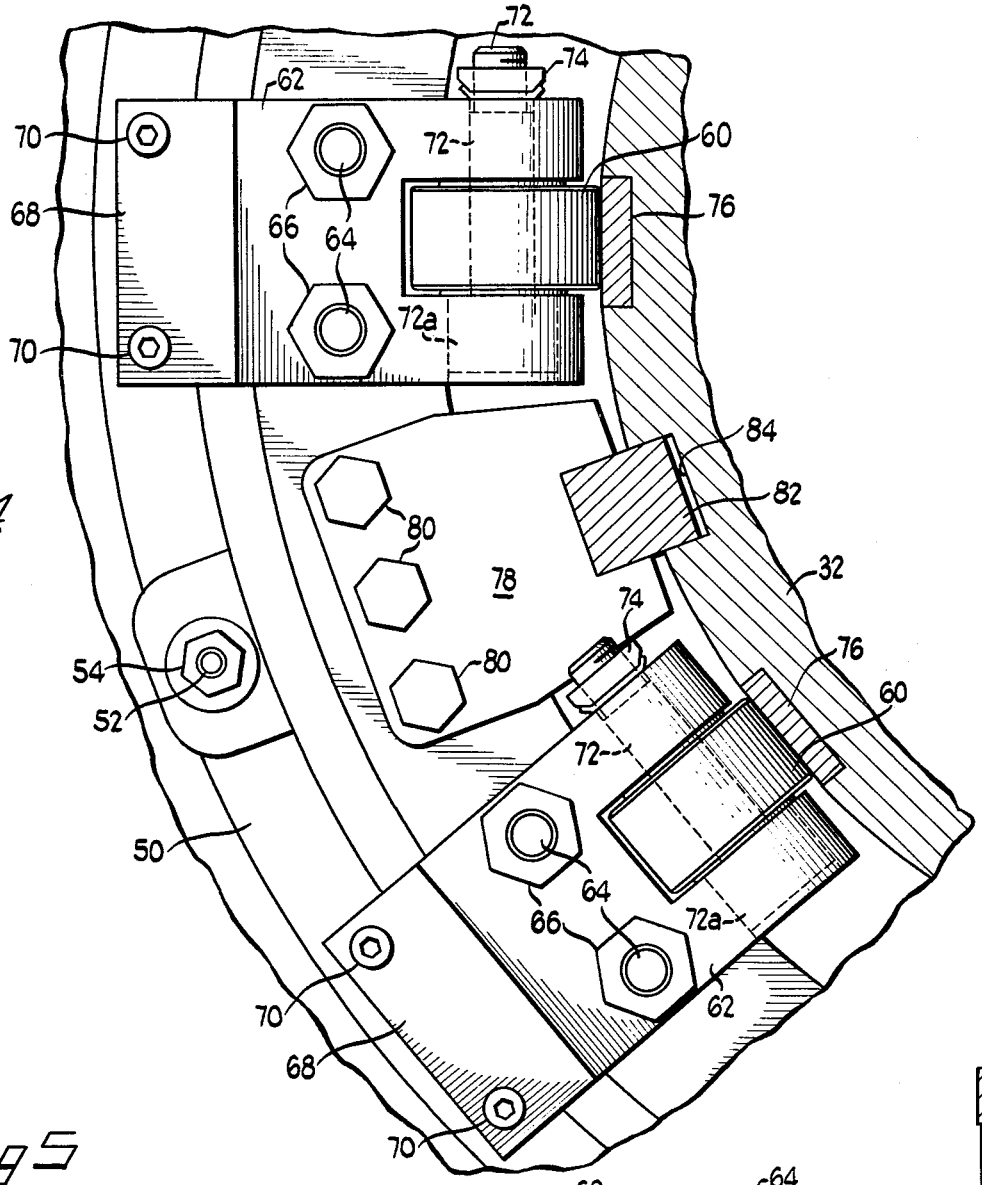
FIG. 4 is an enlarged horizontal view of a portion of the plate member comprising the preloading or prestressing means of this invention, it being an enlargement of a portion of said means shown in FIG. 2.

Referring, now, in greater detail to FIGS. 2 and 5 of the drawings, the plate member 50, at the opening 56 therein, has an annular, downwardly facing flange 50a which is received in an annular recess 16b provided at the open end of the cylinder body 16a. The ram extension 32 of the piston body 30 is guided for longitudinal movement by a plurality of circumferentially spaced guide rollers 60, rotatably mounted on roller supports 62, secured, as by screws 64 and 66, to the plate member 50 along an annular recess 50b formed at the periphery of the opening 56 therein. A plurality of brackets 68 are adjustably secured to the plate member 50 by screws 70. Each bracket 68 includes a downwardly extending leg 68a which is received in the recess 50b and which is provided with a cam surface 68b. The cam surface 68b engages a cam surface 62a on the roller supports 62. The roller supports 62 are bifurcated as illustrated in FIG. 4 for receiving the guide rollers 60. A pin 72 having a head 72a extends through the bifurcated end of each of the roller supports 60, and is provided with a reduced threaded portion for receiving a nut 74 for securing the pin 72 in place on the support 62. As best illustrated in FIG. 5, the guide rollers 60 preferably are in the form of a roller bearing having an inner race 60a carried by the pin 72, a plurality of rollers 60b, and an outer race 60c which engages, and guides, the ram extension 32 of the piston body 30. The ram extension 32 advantageously is provided with a plurality of flat inserts 76 which present flat surfaces against which the outer race 60c rolls as the ram extension 32 is moved upwardly and downwardly. These surfaces provide a sound base for preloading the guide rollers 60, as will be described below, and also tend to prevent rotation of the piston body 30 with respect to the cylinder body 16a. In this same connection, as shown in FIG. 4, a bracket 78 desirably is secured as by screws 80 to the plate member 50, and supports a key 82 received in a keyway 84 formed in the ram extension 32 of the piston body 30. The key 82 and the keyway 84 operate to prevent rotation of the piston body with relation to the cylinder body as the piston body is longitudinally moved.

Each of the extensions 58 of the plate member 50 has an end portion 58a which overhangs and extends beyond a wide flange 16c formed at the upper edge of the cylinder body 16a. A retainer plate 86, having a cam surface 86a, is secured to the end of the portion 58a by screws 88. A wedge-like cam member 90, having a cam surface 90a, is secured, as by screws 92, to the underside of the end portion 58a. The cam surface 90a of the member 90 engages the cam surface 86a of the retainer plate 86, while the inner surface 90b of the member 90 engages the outer surface of the flange 16c of the cylinder body 16a.

In utilizing the preloading or prestressing means of the present invention to achieve zero clearance for the guiding of the ram extension 32, and to neutralize any deflection or deformation of the cylinder body 16a under load, the guide rollers 60 are radially adjusted with relation to the ram extension 32 by vertical adjustment of the leg 68a of each bracket 68 with respect to the cam surface 62a on the roller supports 62. When all of the guide rollers 60 are thus appropriately radially adjusted with the desired amount of preloading, zero clearance for the guiding of the ram extension 32 of the piston body 30 is provided. Since the guide rollers 60 are in the form of ball bearings, there is minimum resistance to the longitudinal movement of the ram extension 32 even though it is guided at zero clearance. As in the case of the press disclosed in U.S. Pat. No. 3,592,131, fluid pressure within the cylinder 26 of the press 10 of the present invention causes radial expansion of the cylinder. Fluid pressure is developed by applying load to the movable platen 34 which must be resisted by the stationary platen 22. Under load, the diagonal distance across the tie rods 24 decreases, while the distance across the cylinder 26 at the midpoints between the tie rods 24 increases. The plate member 50, due to its unique mounting in relation to the cylinder 24, does not experience any stresses, and, therefore, any deformation due to fluid pressure within the cylinder 24. In order to compensate for any radical expansion of the cylinder 26 under load, the cam surface 90a of each wedge-like cam member 90 is preselectedly vertically adjusted with respect to the cam surface 86a of each of the retainer plates 86. By thus appropriately prestressing this area of the cylinder body 16a, any radial expansion of the cylinder 26 at the positions where the retainer plate 86 and the wedge-like cam member 90 are located is effectively absorbed or neutralized by the retainer plate 86. The guiding accuracy of the arrangement thereby is maintained during the complete upstroke of the piston body, and no overloading of the rollers 60 occurs.

While for purposes of illustration, one embodiment of this invention has been described, other forms thereof may become apparent to those skilled in the art upon reference to this disclosure, and therefore, this invention is to be limited only by the scope of the appended claims.

What is claimed is:

1. A hydraulic press, comprising: a bed member in the form of a hydraulic cylinder body; a crown; a stationary platen and a movable platen; a plurality of columns for supporting the crown in spaced relation to the bed member; a plurality of tie rods extending through the bed member, the columns and the crown for prestressing the press; a piston body longitudinally movably received in the cylinder body; and cylinder body and piston body prestressing means associated with the cylinder body, said prestressing means including adjustable guide means adapted to engage the piston body for applying a predetermined amount of preloading thereto to provide zero clearance for guiding the piston body, said prestressing means further including adjustable cylinder body engaging means for absorbing any deformation of the cylinder body under load, the piston engaging guide means and the cylinder body engaging means cooperating to maintain zero clearance for guiding the piston body, and to prevent any overloading of the adjustable guide means.

2. A hydraulic press according to claim 1 wherein the guide means and the cylinder body engaging means are carried on a plate member having a central opening through which a portion of the piston body extends, said plate member further having a plurality of spaced extensions adapted to lie substantially midway between the tie rods extending through the columns of the press.

3. A hydraulic press according to claim 2 wherein the guide means includes a plurality of spaced, radially adjustable rollers adapted to engage the piston body, and the cylinder body engaging means includes an adjustable wedge-like member for engaging the outer wall of the cylinder body.

4. A hydraulic press according to claim 2 wherein the outer edge of each of the spaced extensions of the plate member carries adjustable cylinder body engaging means.

5. A hydraulic press according to claim 2 wherein the plate member is provided with two pairs of opposed extensions, and each extension is provided with an overhanging edge portion on each of which adjustable cylinder body engaging means is positioned.

6. A hydraulic press according to claim 3 wherein the spaced, radially adjustable, rollers are arranged in circumferentially spaced relation along the margin of the central opening in the plate member.

7. A hydraulic press according to claim 3 wherein the cylinder body engaging means further includes an adjustable retainer member for the wedge-like member, the retainer member and the wedge-like member being provided with interengageable cam surfaces.

8. A hydraulic press according to claim 2 wherein the piston body is provided with a keyway, and the plate member carries a key for engagement in the keyway of the piston body to prevent rotation of the piston body with relation to the cylinder body under load.

* * * * *